United States Patent [19]

Ebihara

[11] Patent Number: 4,607,777

[45] Date of Patent: Aug. 26, 1986

[54] STAPLER

[75] Inventor: Yoshiyuki Ebihara, Tokyo, Japan

[73] Assignee: Etona Company, Limited, Tokyo, Japan

[21] Appl. No.: 772,741

[22] Filed: Sep. 5, 1985

[30] Foreign Application Priority Data

Sep. 18, 1984 [JP] Japan ..... 59-140418[U]

[51] Int. Cl.[4] ..... B25C 5/02

[52] U.S. Cl. ..... 227/120; 227/156

[58] Field of Search ..... 227/120, 155, 156

[56] References Cited

U.S. PATENT DOCUMENTS

| | | | |
|---|---|---|---|
| 2,296,574 | 9/1942 | Rodgers | 227/120 |
| 3,583,622 | 6/1971 | Graeff | 227/120 |
| 3,640,443 | 2/1972 | Itagaki | 227/120 |
| 4,405,073 | 9/1983 | Escalante | 227/120 |
| 4,542,844 | 9/1985 | Olfsen et al. | 227/120 X |

*Primary Examiner*—Paul A. Bell

*Attorney, Agent, or Firm*—Abelman Frayne Rezac & Schwab

[57] ABSTRACT

The present invention provides an improved and new stapler including a base with an anvil at the forward end thereof, a hollow frame for containing a set of staples and a handle having an integral staple driver formed therein, all of which are molded from a synthetic resin material, said hollow frame including a primary fulcrum element extending downwardly from the underside of said hollow frame at the intermediate point between the opposite ends thereof and an auxiliary fulcrum element extending upwardly from the top face of said hollow frame adjacent to the rearward end thereof, said base including a recess formed therein for receiving the primary fulcrum element of said frame, and said handle including another recess formed therein for receiving the auxiliary fulcrum element on said frame.

9 Claims, 3 Drawing Figures

STAPLER

BACKGROUND OF THE INVENTION

1. Field of the Invention

The present invention relates to a hand-held stapler for use in binding together some material, such as sheets of paper, by means of staples.

2. Description of the Prior Art

Staplers of the prior art generally comprise a base, a hollow frame containing a clip of staples, and a handle, all typically pivotally connected together at their rearward ends by means of a single pin. The assembly of such prior art staplers is troublesome and requires some degree of skill, making them unsuitable for inexpensive mass-production.

SUMMARY OF THE INVENTION

It is therefore an object of the present invention to provide an improved and new stapler which can simply and easily be assembled from a reduced number of parts without special skill by the assembler.

The present invention provides an improved and new stapler comprising a base with an anvil at the forward end thereof, a hollow frame for containing a set of staples and a handle having an integral staple driver formed therein, all the members being molded from a synthetic resin material, said hollow frame including a primary fulcrum element extending downwardly from the underside of said hollow frame at the intermediate point between the opposite ends thereof and an auxiliary fulcrum element extending upwardly from the top face of said hollow frame adjacent to the rearward from the top face of said hollow frame adjacent to the rearward end thereof, said base including a recess formed therein for receiving the primary fulcrum element of said frame, and said handle including another recess formed therein for receiving the auxiliary fulcrum element on said frame.

DETAILED DESCRIPTION OF PREFERRED EMBODIMENT

Figure 1:
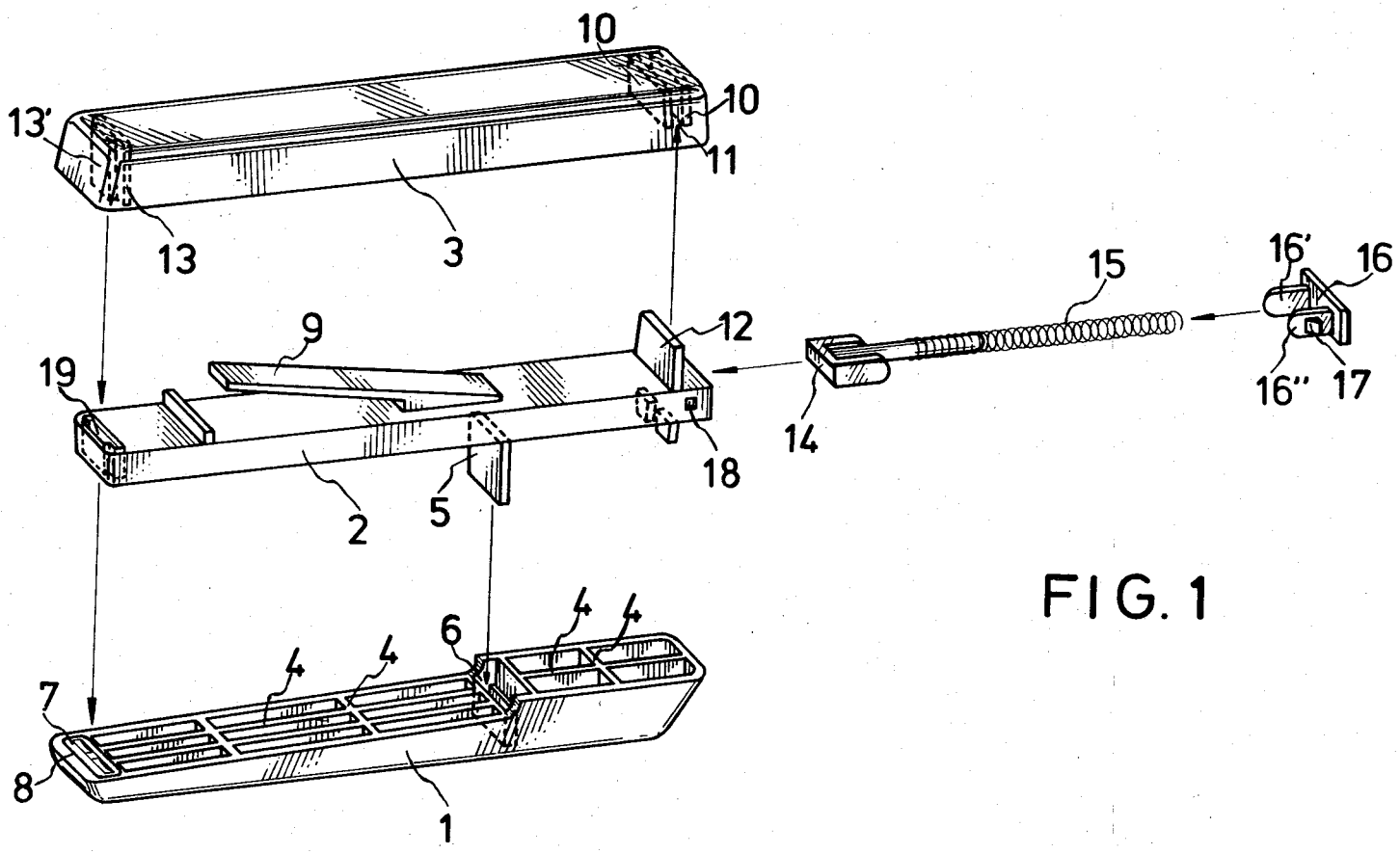
FIG. 1 is an exploded perspective view of a stapler constructed according to the present invention.

Referring to FIG. 1, there is shown a stapler comprising a base 1, a hollow frame or magazine 2 for receiving a set of staples, and a handle 3, all of which can be molded from any suitable material, such as synthetic resin material.

The base 1 includes longitudinal (4) and transverse (4A) strengthening ribs, and an anvil 7 fitted into the forward recessed portion 8 of the base 1.

The tublar hollow frame 2 has resilient primary fulcrum element 5 extending downwardly from the underside of frame 2 at an intermediate point between the frame ends. This primary fulcrum element 5 is adapted to be received in a recess 6 formed in base 1 at the corresponding base location. Frame 2 also includes a resilient spring element or arm 9 integrally formed on frame 2 and obliquely extending forward and upward from the frame's top face. The frame 2 further includes an auxiliary fulcrum element 12 extending upwardly from the frame's top face adjacent to the frame's rearward end. Auxiliary fulcrum element 12 is adapted to be received in a recess 11 formed in a support member 10 which itself is formed inside the handle 3 at the handle's rearward end.

The handle 3 also includes a staple driver 13, formed integrally inside it at its forward end, having a thick-walled strengthening portion 13A.

Figure 2:
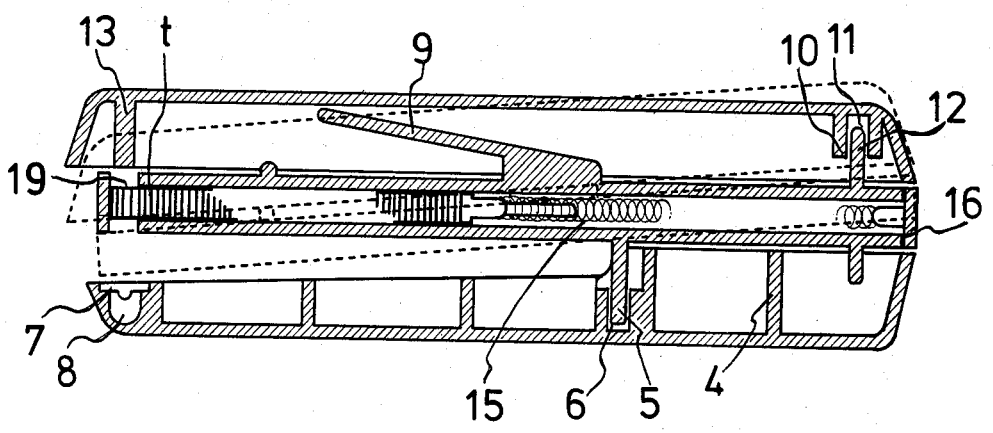
FIG. 2 is a longitudinal cross-section of the assembled stapler.

Hollow frame 2 further includes an passage opening 19 formed through its top wall adjacent to the forward end and shaped to permit the staple driver 13 of handle 3 to pass through during operation to drive a staple. As seen from FIG. 2, the interior of frame 2 receives a clip of inversely U-shaped staples (t), the rearward end of which is engaged by a magazine follower 14 similarly received in the hollow portion of the frame 2 from a rearward open end of frame 2. The rearward open end of frame 2 is closed by a cap 16 which has a pair of internal legs 16A and 16B adapted to contact the opposite inner sidewalls of the hollow frame portion. Each of the internal cap legs 16A and 16B has a locking projection 17 adapted to engage in a corresponding aperture 18 formed on each of the inner sidewalls of the hollow frame portion adjacent the frame's rearward end. Thus, once pushed on in place the cap 16 can be firmly be locking projections 17 on the rearward end of frame 2. Between the magazine follower 14 and the cap 16, a coil spring 15 is operably located for resiliently urging the clip of staples (t) forward by pressing on magazine follower 14 in frame 2. As shown in FIG. 2, the bottom wall of frame 2 is provide a passage opening 19A permitting staples (t) to be driven through it one at a time when the foremost staple is pushed down by staple driver 13 as will afterwards be described.

When a stapler is to be assembled into a unit, the primary fulcrum element 5 of frame 2 is inserted into recess 6 of base 1 while at the same time the auxiliary fulcrum element 12 of the staple-loaded frame 2 is inserted into recess 11 within the handle 3. At this time, as shown in FIG. 2 the spring element on arm 9 on the frame 2 engages the top inner wall of the handle 3 to resiliently hold the handle 3 in such a position as shown by solid lines. Thus, the stapler can simply and easily be assembled from a reduced number of parts without skill.

Figure 3:
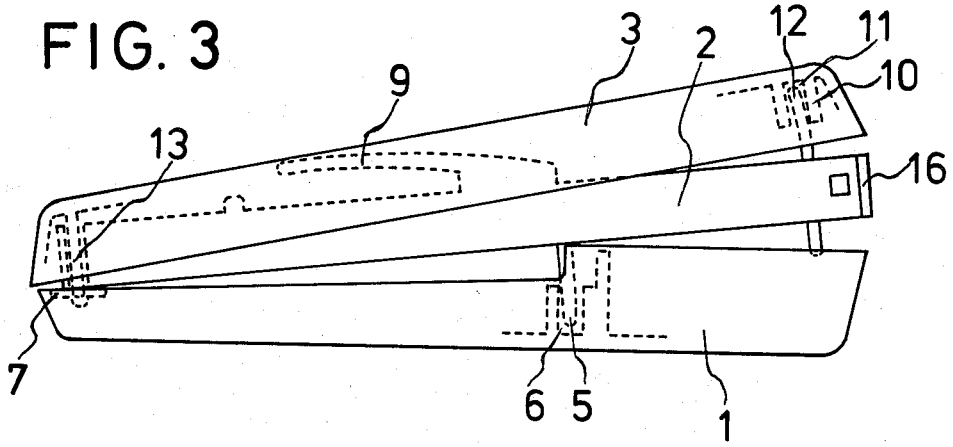
FIG. 3 is a side view, partly broken away, showing the stapler being operated, in which state the handle is manually depressed.

On operation, the forward end of handle 3 is manually depressed in the conventional manner. As a result, the handle 3 and frame 2 are first displaced about the primary fulcrum element 5, which is elastically bent near its junction with the frame as shown by broken line in FIG. 2. This causes the forward end of frame 2 to contact the top face of the base 1. On further depression of the handle 3, it only is further pivoted about the auxiliary fulcrum element 12 to press down spring arm 9 and urge the staple driver 13 through the top opening 19 in frame 2. Therefore, as shown in FIG. 3, the foremost staple of the clip of staples (t) within the frame 2 will be driven toward the anvil 7 of the base 1 through the bottom opening 19A of the frame 2 by the staple driver 13 to effect a binding operation of material (not shown), such as paper, inserted between the anvil 7 and the forward end of frame 2. Letting up on handle 3 permits the resilience of spring arm 9 and the primary fulcrum element 5 to retract the stapler parts to the normal (ready for use) position.

I claim:

1. A stapler comprising a base with an anvil at the forward end, a hollow frame comprising a magazine for containing a clip of staples, and a handle having an integrally formed staple driver, all of which are molded from a synthetic resin material; the hollow frame including a primary fulcrum element extending downwardly from the frame's underside at a point intermediate the opposite frame ends, and an auxiliary fulcrum element extending upwardly from the frame's top face at a point adjacent the frame's rearward end; said base including a primary recess formed in it for receiving the frame's primary fulcrum element; and said handle including an auxiliary recess formed in it for receiving the frame's auxiliary fulcrum element.

2. A stapler as defined in claim 1, wherein a resilient means is integrally formed on the frame for engaging the inner wall of the handle in the assembled stapler.

3. A stapler as defined in claim 1 or 2, wherein the base includes integrally formed strengthening rib means.

4. A stapler comprising:

(a) an intermediate tubular frame for containing a clip of staples and including
  (i) a resilient primary fulcrum element extending downwardly from the frame's underside at a point intermediate the frame ends,
  (ii) an auxiliary fulcrum element extending upwardly from the frame's top side adjacent the frame's rear end, and
  (iii) a passage opening, at the frame's forward end, through which staples can be driven of the frame one at a time;

(b) a base having
  (i) an integrally formed primary recess for receiving the frame's primary fulcrum at a corresponding point intermediate the base ends, and
  (ii) an anvil, for bending staples, in the base's top side at its forward end;

(c) an operating handle having
  (i) an integrally formed recess within its rear end for receiving the frame's auxiliary fulcrum; and
  (ii) an integrally formed downwardly extending staple driver at its front end; and (d) resilient handle spring means between the frame and the operating handle.

5. The stapler of claim 4 wherein the handle spring means is a resilient arm attached to the frame's top and joining it an oblique angle.

6. The stapler of claim 4 or 5 wherein the tubular frame is loaded with a clip of staples that is resiliently biased towards the frame's passage opening.

7. The stapler of claim 4 or 5 wherein the tubular frame and its primary and auxiliary fulcrum elements are integrally molded from a plastic material.

8. The stapler of claim 7 wherein the handle spring means is also integrally molded of plastic material.

9. The stapler of claim 8 wherein the base and handle are each molded from a plastic material.

* * * * *